US006319645B1

(12) United States Patent
Murti et al.

(10) Patent No.: US 6,319,645 B1
(45) Date of Patent: Nov. 20, 2001

(54) IMAGING MEMBERS

(75) Inventors: Dasarao K. Murti; James M. Duff, both of Mississauga; C. Geoffrey Allen, Waterdown, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/791,928

(22) Filed: Feb. 26, 2001

(51) Int. Cl.[7] ..... G03G 5/047
(52) U.S. Cl. ..... 430/58.65; 430/59.4
(58) Field of Search ..... 430/58.65, 59.4

(56) References Cited

U.S. PATENT DOCUMENTS

| | | | |
|---|---|---|---|
| 4,265,990 | 5/1981 | Stolka et al. | 430/59 |
| 4,419,427 | 12/1983 | Graser et al. | 430/58 |
| 4,429,029 | 1/1984 | Hoffmann et al. | 430/57 |
| 4,517,270 | 5/1985 | Graser et al. | 430/58 |
| 4,555,463 | 11/1985 | Hor et al. | 430/59 |
| 4,587,189 | 5/1986 | Hor et al. | 430/59 |
| 4,719,163 | 1/1988 | Staudenmayer et al. | 430/58 |
| 4,746,741 | 5/1988 | Staudenmayer et al. | 546/37 |
| 4,937,164 | 6/1990 | Duff et al. | 430/58 |
| 4,968,571 | 11/1990 | Gruenbaum et al. | 430/58 |
| 5,587,263 | 12/1996 | Nukada et al. | 430/56 |
| 5,645,965 | 7/1997 | Duff et al. | 430/59 |
| 5,683,842 | 11/1997 | Duff et al. | 430/59 |
| 5,817,739 | 10/1998 | Nukada et al. | 528/292 |
| 5,853,934 | 12/1998 | Watanabe et al. | 430/59 |
| 6,099,996 * | 8/2000 | Yanus et al. | 430/58.65 |

* cited by examiner

*Primary Examiner*—John Goodrow
(74) *Attorney, Agent, or Firm*—E. O. Palazzo

(57) ABSTRACT

A photoconductive imaging member containing a photogenerating layer and a triphenylamine charge transport layer of the formula or optionally mixtures thereof

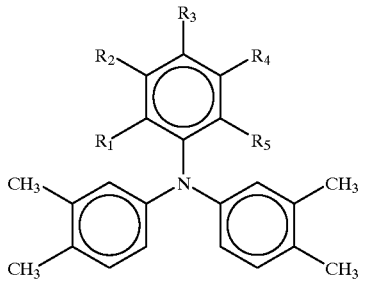

wherein $R_1$, $R_2$, $R_3$, $R_4$, and $R_5$ are each independently alkyl, aryl, hydrogen, alkoxy, and the like.

35 Claims, No Drawings

IMAGING MEMBERS

RELATED PATENTS

There is illustrated in U.S. Pat. No. 5,645,965, the disclosure of which is totally incorporated herein by reference, photoconductive imaging members with symmetrical dimeric perylenes, and in U.S. Pat. No. 5,683,842, the disclosure of which is totally incorporated herein by reference, there is disclosed photoconductive imaging members with unsymmetrical dimer perylenes. A number of the components of the imaging members of these patents, such as the substrates, resin binders, photogenerating pigments, and the like, can be selected for the imaging members of the present invention in embodiments thereof.

A number of patents illustrate imaging members with charge transport molecules and components, such as U.S. Pat. No. 4,265,990, aryl amines, and certain amines, reference U.S. Pat. Nos. 5,853,934; 5,817,739, and 5,587,263, the disclosures of which are totally incorporated herein by reference. A number of the components of the imaging members of these patents, such as the substrates, resin binders, photogenerating pigments, and the like, can be selected for the imaging members of the present invention in embodiments thereof.

BACKGROUND OF THE INVENTION

The present invention is directed generally to photoconductive components, and more specifically, to imaging members containing triphenylamines, and which amines are, for example, of the Formula I illustrated herein and wherein, for example, two of the aryl groups are 3,4-dimethylphenyl and the third aryl is a different phenyl group with, for example, from about 1 to about 5 substituents inclusive of hydrogen, linear or branched alkyl with from about 2 to about 18 carbons such as, for example, methyl, ethyl, n-propyl, n-butyl isopropyl, sec-butyl, 2-methylbutyl, neopentyl, 2-ethylhexyl and the like, alkyl like cycloalkyl such as cyclopentyl, cyclohexyl, cyclooctyl or cyclododecyl, substituted alkyl such as, for example, 3-methyoxypropyl, 4-hydroxybutyl, aralkyl like benzyl and phenethyl, and wherein the molecular weight $M_W$ of the triphenylamine is, for example, from about 301 to about 600, and yet more specifically, is from about 357 to about 425 Daltons, which weight can enable a reduction in environmental contamination Formula 1

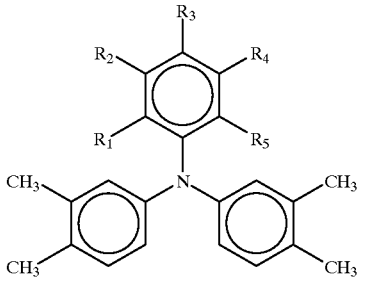

wherein $R_1$ to $R_5$ each are, for example, independently hydrogen, alkyl, aryl, cycloalkyl, alkoxy substituted alkyl or aralkyl, and the like, wherein alkoxy and alkyl contain, for example, from about 1 to about 25 carbon atoms; cycloalkyl contains from about 3 to about 35 carbon atoms; and aryl contains, for example, from about 6 to about 30 carbon atoms.

The hole-transporting triphenylamines of the present invention in embodiments do not significantly absorb light at a wavelength of from about 390 to about 450 nanometers. For example, solutions of these amines in an organic solvent or in a polymer binder such as polystyrene, polyester or polycarbonate at a concentration of about 50 percent (weight to volume) exhibit about 99 percent or more light transmission through a path length of from about 10 to about 100 micrometers at 400 nanometers.

Examples of specific triphenylamines or anilines with, for example, from about 390 to about 450 nanometers absorption depending, for example, on the amount of amine present and other factors are illustrated by Formulas 2a to d.

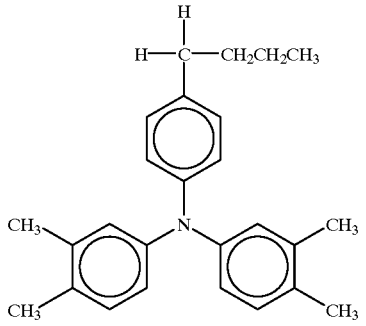

2a. N, N-bis(3, 4-dimethylphenyl)-4-n-butylaniline

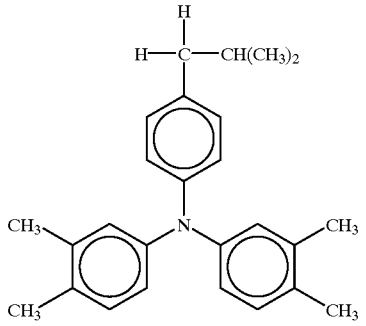

2b. N, N-bis(3, 4-dimethylphenyl)-4-isobutylaniline

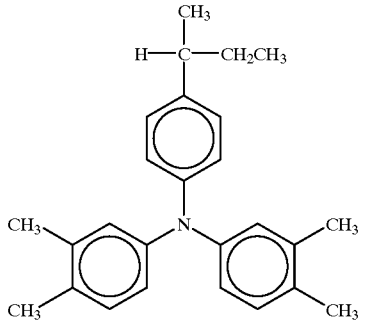

2c. N, N-bis(3, 4-dimethylphenyl)-4-sec-butylaniline

-continued

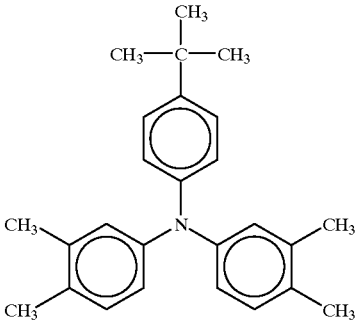

2d. N, N-bis(3, 4-dimethylphenyl)-4-tert-butylaniline

The triphenylamines illustrated herein can be selected as a charge transport, especially hole transport component in photoconductive imaging members useful in electrophotographic imaging and printing, and more specifically, in imaging and printing systems including color systems wherein light exposures of about 390 to about 450 nanometers are selected, and wherein a blue laser or ROS is selected.

PRIOR ART

Generally, layered photoresponsive imaging members are described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent can comprise a material which is substantially incapable of transporting for any significant distance injected charge carriers generated by the photoconductive particles.

The selection of selected perylene pigments as photoconductive substances are also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with spectral response in the wavelength region of 400 to 700 nanometers. A similar disclosure is presented in Ernst Gunther Schlosser, *Journal of Applied Photographic Engineering,* Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. Also, there is specifically disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a non-halogenated perylene pigment photogenerating component. Both of the aforementioned patents and a number of the following patents disclose an aryl amine component as a hole transport layer.

Moreover, there is disclosed in U.S. Pat. No. 4,419,427, the disclosure of this is totally incorporated herein by reference, electrographic recording media with a photosemiconductive double layer comprised of a first layer containing a charge carrier perylene diimide dye, and a second layer with one or more compounds which are charge transporting materials when exposed to light.

U.S. Pat. No. 4,419,427, the disclosure of which is totally incorporated herein by reference, discloses the use of dispersions of perylene bisimides, with bis(2,6-dichlorophenylimide) being a specific material, in binder resins as CGL (charge generating layers) layers in devices overcoated with a charge transporting layer such as a poly (vinylcarbazole) composition. U.S. Pat. No. 4,429,029, the disclosure of which is totally incorporated herein by reference, illustrates the use, in devices similar to those of the '427 patent, of bisimides and bisimidazo perylenes in which the perylene nucleus is halogenated to an extent where 45 to 75 percent of the perylene ring hydrogens have been replaced by halogen. U.S. Pat. No. 4,587,189, the disclosure of which is totally incorporated herein by reference, illustrates layered photoresponsive imaging members prepared with highly-loaded dispersions, vacuum evaporated thin coatings of cis- and trans-bis(benzimidazo) perylene (4a, X=1,2-phenylene) and other perylenes overcoated with hole transporting compositions comprised of a variety of N,N,N',N'-tetraaryl4,4'-diaminobiphenyls. U.S. Pat. No. 4,937,164 illustrates the use of perylene bisimides and bisimidazo pigments in which the 1,12-and/or 6,7 position of the perylene nucleus is bridged by one or two sulfur atoms wherein the pigments in the CGL layers are either vacuum evaporated or dispersed in binder resins and a layer of tetraaryl biphenyl hole transporting molecules.

U.S. Pat. No. 4,517,270, the disclosure of which is totally incorporated herein by reference, illustrates bisimides with propyl, hydroxypropyl, methoxypropyl and phenethyl substituents (4a, R=$CH_3CH_2CH_2$—, $HOCH_2CH_2CH_2$—, $CH_3OCH_2CH_2CH_2$—, and $C_6H_5CH_2CH_2$—) which are black or dark primarily because of their crystal properties, and perylene pigments which are nuclearly substituted with anilino, phenylthio, or p-phenylazoanilino groups. Similarly, in U.S. Pat. Nos. 4,719,163 and 4,746,741, the disclosures of this are totally incorporated herein by reference, there are disclosed layered electrophotographic devices having a certain spectral response to beyond 675 nanometers.

Dimeric perylene bisimide pigments are also known. For example, U.S. Pat. No. 4,968,571, the disclosure of this is totally incorporated herein by reference, discloses dimers of the type shown in Formula 3 wherein $R_1$ and $R_2$ are phenethyl groups and X is 1,4-phenylene, and wherein the charge transport can be an aryl amine.

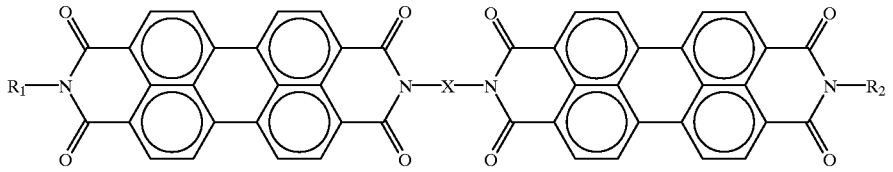

Formula 3. Illustrative Formula of Dimeric Perylene Bisimide Pigment

Also, U.S. Pat. No. 5,645,965, the disclosure of which is totally incorporated herein by reference, illustrates symmetrical perylene bisimide dimers of the type illustrated in Formula 3, wherein $R_1$ and $R_2$ are identical and U.S. Pat. No. 5,683,842, the disclosure of which is totally incorporated herein by reference, describes internally unsymmetrical bisimide dimers in which $R_1$ and $R_2$ are the same and wherein X in Formula 1 is an unsymmetrical bridging group. A number of the components of the imaging members of the above patents such as the substrates, resin binders, charge transports, and the like can be selected for the imaging members of the present invention.

While the above described layered photoreceptors, or photoconductive imaging members may exhibit desirable xerographic electrical characteristics, they are not believed to permit sufficient light to be transmitted through the hole transport layer to the photogenerator layer when, for example, blue lasers are selected; on average, the invention imaging members allow sufficient light transmission and thus exhibit excellent photosensitivities as indicated by the measured $E_{1/2}$ values. This measurement, which is used routinely in photoreceptor technology refers to the energy required (in ergs/square centimeter) to discharge a photoreceptor from an initial surface charge to one half of this initial value, for example from 800 to 400 volts surface potential. An $E_{1/2}$ value of about 10 to about 12 erg/cm$^2$ could be classified as acceptable, 5 to 6 erg/cm$^2$ as good, and values below about 3 erg/cm$^2$ as excellent. Although a number of known imaging members are suitable for their intended purposes, a need remains for imaging members containing improved charge transport components. In addition, a need exists for imaging members containing photoconductive and triarylamine components with improved xerographic electrical performance including higher charge acceptance, lower dark decay, increased charge generation efficiency, charge injection into the transporting layer, tailored PIDC (Photo-Induced Discharge Curve) shapes to enable a variety of reprographic applications, reduced residual charge and/or reduced erase energy, improved long term cycling performance, and less variability in performance with environmental changes in temperature and relative humidity. Additionally, there is a need for imaging members with enhanced light transmission in the blue region of the light spectrum of, for example, from about 390 to about 450 nanometers, enabling the resulting imaging members thereof to be selected for imaging by blue lasers. These and other needs may be accomplished, it is believed, in embodiments of the present invention.

The disclosures of each of the U.S. patents cited herein are totally incorporated herein by reference.

SUMMARY OF THE INVENTION

Examples of features of the present invention include:

It is a feature of the present invention to provide imaging members with many of the advantages illustrated herein.

It is another feature of the present invention to provide imaging members with substituted triphenyl amine charge transport molecules.

Additionally, in another feature of the present invention there are provided imaging members, especially photoconductive members with photogenerating layers and a charge transport layer in contact therewith, and wherein the charge transport layer is a substituted triphenylamine.

It is another feature of the present invention to provide layered photoconductive members in which the top transport layer is transparent to light in the wavelength range for 390 to 450 nanometers.

It is another feature of the present invention to provide photoconductive imaging members with phthalocyanine and dimeric perylene photogenerating pigments and that enable imaging members with improved photosensitivity in the blue wavelength region of the light spectrum, such as from about 390 to about 450 nanometers, and imaging members with substituted triphenylamine charge transport components with high mobility, for example equal to or greater than about $1\times10^{-5}$ cm$^2$/V.sec and relatively low residual voltage, for example less than about 30 volts.

Aspects of the present invention relate to a photoconductive imaging member comprised in sequence of a supporting substrate, an optional blocking and an optional adhesive layer, a photogenerating layer, and a triphenylamine charge transport layer and wherein the triphenylamine is of the alternative formulas as encompassed by Formula 1; an imaging member wherein the supporting substrate is a metal, a conductive polymer, or an insulating polymer, each with a thickness of from about 30 microns to about 300 microns optionally overcoated with an electrically conductive layer with an optional thickness of from about 0.01 micron to about 1 micron; an imaging member wherein there is further included an overcoating polymer top layer on the member; an imaging member wherein the photogenerator layer component is dispersed in a resinous binder in an amount of from about 5 percent to about 95 percent by weight; an imaging member wherein the resinous binder is a polyester, a polyvinylcarbazole, a polyvinylbutyral, a polycarbonate, a polyethercarbonate, an aryl amine polymer, a styrene copolymer, or a phenoxy resin; an imaging member wherein the charge transport layer molecules are dispersed in a highly insulating polymer in an amount of from about 20 to about 60 percent; an imaging member wherein the highly insulating polymer is a polycarbonate, a polyester, or a vinyl polymer; an imaging member wherein the photogenerating layer is of a thickness of from about 0.2 to about 10 microns, wherein the charge transport layer is of a thickness of from about 10 to about 100 microns, and wherein the supporting substrate is overcoated with a polymeric adhesive layer of a thickness of from about 0.01 to about 1 micron; an imaging method comprising the formation of a latent image on the photoconductive imaging member illustrated herein, developing the image with a toner composition comprised of resin and colorant, transferring the image to a substrate, and optionally fixing the image; an imaging member wherein the glass transition temperature of the charge transport layer can be tuned or controlled by utilizing in this layer at least two similar or dissimilar hole transport molecules, and optionally wherein the glass transition temperature Tg of the charge transport layer is linearly related to the Tg of the transport molecules contained in the charge transport layer, and optionally wherein the incorporation of plasticizers in the charge transport layer is avoided, and wherein the charge transport layer contains at least two, and more specifically, two hole transport components comprised of a mixture of triarylphenyl amines illustrated herein or the amines of U.S. Pat. Nos. 5,495,049 and 5,587,263, the disclosures of which are totally incorporated herein by reference.

The imaging members of the present invention as recited in the claims as filed include a photoconductive imaging member comprised of a photogenerating layer and a triphenylamine charge transport layer of the formula

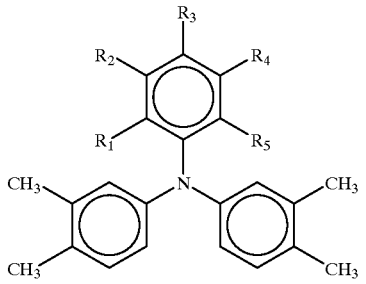

wherein $R_1$, $R_2$, $R_3$, $R_4$, and $R_5$ are each independently alkyl, aryl, hydrogen, or alkoxy; a photoconductive imaging member wherein each R is alkyl with from 1 to about 25 carbon atoms; a photoconductive imaging member wherein each R is methyl; a photoconductive imaging member wherein each R is $CH_2CH_2CH_2CH_3$; a photoconductive imaging member wherein each R is $CHCH_3CH_2CH_3$; a photoconductive imaging member wherein each R is $C(CH_3)_3$; a photoconductive imaging member wherein the triarylamine is N,N-bis(3,4-dimethylphenyl)-4-sec-butylaniline; a photoconductive imaging member wherein the triarylamine is N,N-bis(3,4-dimethylphenyl)-4-n-butylaniline; a photoconductive imaging member further containing a supporting substrate; a photoconductive imaging member wherein there is contained on the substrate an adhesive layer, and wherein the photogenerating layer is situated between the substrate and the transport layer; a photoconductive imaging member wherein there is further included a supporting substrate in contact with the photogenerating layer, and wherein there is situated on the charge transport layer a polymeric overcoating; a photoconductive imaging member wherein aryl contains from 6 to about 30 carbon atoms; a photoconductive imaging member wherein the triarylamine is dispersed in a binder; a photoconductive imaging member wherein the photogenerating layer is comprised of a metal free phthalocyanine, or wherein the photogenerating layer is comprised of a metal phthalocyanine; a photoconductive imaging member wherein the photogenerating layer is comprised of a titanium phthalocyanine; a photoconductive imaging member wherein the photogenerating layer is comprised of a hydroxygallium phthalocyanine; a photoconductive imaging member wherein the photogenerating layer is comprised of a chlorogallium phthalocyanine; a photoconductive imaging member wherein the photogenerating layer is comprised of trigonal selenium, chlorogallium phthalocyanine, hydroxygallium phthalocyanine, titanyl phthalocyanines, dibromoanthanthrone, bis(benzimidazo) perylene, N,N'-dipropyl-perylene-3,4,9,10-tetracarboxylic acid diimide, or N,N'-diphenethyl-perylene-3,4,9,10-tetracarboxylic acid diimide; a photoconductive imaging member further including a supporting substrate of a metal, a conductive polymer, or an insulating polymer, each with a thickness of from about 30 microns to 300 microns optionally overcoated with an electrically conductive layer with an optional thickness of from about 0.01 micron to about 1 micron; a photoconductive imaging member wherein there is further included an overcoating polymer top layer on the member; a photoconductive imaging member wherein the photogenerator layer component is dispersed in a resinous binder in an amount of from about 5 percent to about 95 percent by weight; a photoconductive imaging member wherein the resinous binder is a polyester, a polyvinylcarbazole, a polyvinylbutyral, a polycarbonate, a polyethercarbonate, an aryl amine polymer, a styrene copolymer, or a phenoxy resin; a photoconductive imaging member wherein the charge transport layer is dispersed in a polymer in an amount of from about 20 to about 60 percent; a photoconductive imaging member wherein the polymer is a polycarbonate, a polyester, or a vinyl polymer; a photoconductive imaging member wherein the photogenerating layer is of a thickness of from about 0.2 to about 10 microns, wherein the charge transport layer is of a thickness of from about 10 to about 100 microns, and further including a supporting substrate overcoated with a polymeric adhesive layer of an optional thickness of from about 0.01 to about 1 micron; an imaging method comprising the formation of a latent image on the photoconductive imaging member of the present invention developing the image with a toner composition comprised of resin and colorant, transferring the image to a substrate, and optionally fixing the image thereto; an imaging member comprised of a photogenerating layer and a charge transport layer represented by the formula

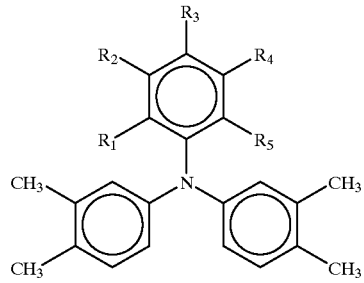

wherein each $R_1$ to $R_5$ is alkyl; an imaging member wherein alkyl contains from 1 to about 12 carbon atoms; an imaging member wherein the member includes a supporting substrate, and the photogenerating layer is situated between the substrate and the charge transport, and wherein the charge transport is a hole transport; an imaging member wherein the triarylamine is N,N-bis(3,4-dimethylphenyl)-4-sec-butylaniline, or wherein the triarylamine is N,N-bis(3,4-dimethylphenyl)-4-n-butylaniline; an imaging member comprised of a photogenerating layer and a charge transport layer represented by the formula

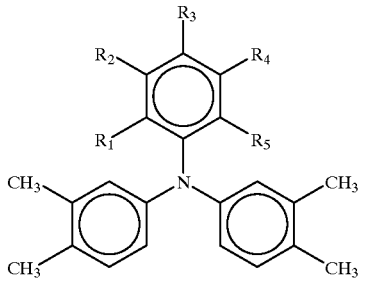

wherein each R, $R_1$ to $R_5$ is aryl; an imaging member wherein the member includes in sequence a supporting substrate, an adhesive layer, a hole blocking layer, the photogenerating layer and the charge transport layer, and wherein the charge transport is a hole transport; a photoconductive imaging member wherein a mixture of triphenylamines is selected; a photoconductive imaging member wherein alkyl is cycloalkyl, and alkoxy contains from about 2 to about 10 carbon atoms; a number of the imaging members of the present invention possess a dark decay of less than about 50 volts per second, for example about 5 to about 45, photosensitivities ranging from $E_{1/2}$ of less than about 3 ergs when they are exposed with light in the wavelength range of from about 390 to about 450 nanometers.

The substrate can be comprised of any suitable component, for example it can be formulated entirely of an electrically conductive material, or it can be comprised of an insulating material having an electrically conductive surface. The substrate can be of any effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects thereof. In one embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. Generally, the conductive layer ranges in thickness of, for example, from about 50 Angstroms to about 100 centimeters, although the thickness can be outside of this range. When a flexible electrophotographic imaging member is desired, the substrate thickness typically is, for example, from about 100 Angstroms to about 750 Angstroms.

The substrate can be comprised of organic and inorganic materials, such as insulating nonconducting materials such as various resins known for this purpose including polycarbonates, polyamides, polyurethanes, paper, glass, plastic, polyesters, such as MYLAR® (available from E. I. DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

An optional intermediate adhesive layer may be situated between the substrate and subsequently applied layers to, for example, improve adhesion. When such adhesive layers are utilized, they preferably have a dry thickness of, for example, from about 0.1 micron to about 5 microns, although the thickness can be outside of this range. Typical adhesive layers include film-forming polymers such as polyester, polyvinylbutyral, polyvinylpyrrolidone, polycarbonate, polyurethane, polymethylmethacrylate, and the like as well as mixtures thereof. Since the surface of the substrate can be a metal oxide layer or an adhesive layer, the expression substrate is intended to also include a metal oxide layer with or without an adhesive layer on a metal oxide layer. Moreover, other known layers may be selected for the photoconductive imaging members of the present invention, such as polymer protective overcoats, and the like.

The photogenerating layer is of an effective thickness, for example, of from about 0.05 micron to about 10 microns or more, and in embodiments has a thickness of from about 0.1 micron to about 3 microns. The thickness of this layer may be dependent primarily upon the concentration of photogenerating material in the layer, which may generally vary from about 5 to about 100 percent. The 100 percent value generally occurs when the photogenerating layer is prepared by vacuum evaporation of the photogenerating pigment or pigments. When the photogenerating material is present in a binder material, the binder contains, for example, from about 25 to about 95 percent by weight of the photogenerating material, and preferably contains about 60 to 80 percent by weight of the photogenerating material. Generally, it is desirable to provide this layer in a thickness sufficient to absorb about 90 to about 95 percent or more of the incident radiation which is directed upon it in the imagewise or printing exposure step. The maximum thickness of this layer is dependent primarily upon factors, such as mechanical considerations, such as the specific photogenerating compound selected, the thicknesses of the other layers, and whether a flexible photoconductive imaging member is desired. Examples of photogenerating pigments that can be selected include perylenes, metal free phthalocyanines, metal phthalocyanines, and other suitable known pigments. Specific examples of pigments are trigonal selenium, chlorogallium Phthalocyanine, hydroxygallium phthalocyanine, titanyl phthalocyanines, vanadyl phthalocyanine, x-form metal-free phthalocyanine, copper phthalocyanine, dibromoanthanthrone, bis(benzimidazo) perylene, N,N'-dipropyl-perylene-3,4,9,10-tetracarboxylic acid diimide, N,N'-diphenethyl-perylene-3,4,9,10-tetracarboxylic acid diimide, and the symmetrical and unsymmetrical dimeric perylene bisimides and mixtures thereof described in U.S. Pat. Nos. 5,645,965; 5,683,842 and 6,051,351, the disclosures of which are totally incorporated herein by reference. Preferred photogenerator pigments are those having strong light absorption in the 390 to 450 nanometers region such as trigonal selenium, phthalocyanine pigments, and the like.

The charge transport component is present in the charge transport layer in an effective amount, generally from about 5 to about 90 percent by weight, preferably from about 20 to about 75 percent by weight, and more preferably from about 30 to about 60 percent by weight, although the amount can be outside of these ranges.

Examples of resinous components for the transport layer include binders such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight $M_W$ of from about 20,000 to about 100,000 with a molecular weight in the range of from about 50,000 to about 100,000 being particularly preferred. Generally, the resinous binder contains from about 5 to about 90 percent by weight of the hole transport material, and preferably from about 20 percent to about 75 percent of this material.

Similar binder materials may be selected for the photogenerating layer, including polyesters, polyvinyl butyrals, polyvinylcarbazole, polycarbonates, polyvinyl formals, poly (vinylacetals) and those illustrated in U.S. Pat. No. 3,121,006, the disclosure of which is totally incorporated herein by reference.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is of a thickness of less than 50 Angstroms to about 10 microns, preferably being no more than about 2 microns. In addition, the photoconductive imaging member may also optionally contain a second adhesive interface layer situated between the hole blocking layer and the photogenerating layer. This layer may comprise a polymeric material such as polyester, polyvinyl butyral, polyvinyl pyrrolidone and the like. Typically, this layer is of a thickness of less than about 0.6 micron, or more specifically, from about 0.1 to about 0.5 micron.

The present invention also encompasses imaging and printing devices and methods for generating images with the photoconductive imaging members disclosed herein. One method comprises generating an electrostatic latent image on the photoconductive imaging member of the present invention, developing the latent image with a toner comprised of resin, colorant like carbon black, and optionally charge additive, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate, such as paper, may be by any method, including those wherein there is selected a corotron or a biased roll. Fixing may be performed by means of any suitable method, such as flash fusing, heat fusing, pressure fusing, vapor fusing, and the like. Any substrate selected for xerographic copiers and printers, including digital copiers, may be used as a substrate, such as paper, transparency, and the like.

Specific embodiments of the invention will now be described in detail. These Examples are intended to be illustrative, and the invention is not limited to the materials, conditions, or process parameters set forth in these embodiments. All parts and percentages are by weight unless otherwise indicated.

PREPARATION OF TRIPHENYLAMINE HOLE TRANSPORT MOLECULES

All starting materials for the following syntheses were purchased commercially and were used without further purification. The structure, formula, and purity of the products were ascertained by proton magnetic resonance spectroscopy and by elemental (CHN) analysis. Purity was established by high performance liquid chromatography and melting points were determined by differential scanning calorimetry (DSC).

EXAMPLE I

Synthesis of N,N-Bis(3,4-dimethylphenyl)-4-n-butylaniline a) Synthesis of Crude Product A 1 liter flask was charged with 4-n-butylaniline (83.5 grams, 0.559 mole), 4-iodo-ortho-xylene (284 grams, 1.23 mole), cuprous chloride (2.21 grams, 0.022 mole), 1,10-phenanthrolene (3.96 grams, 0.022 mole), potassium hydroxide (Technical Flakes, 251 grams, 4 5 mole) and 300 milliliters of toluene. The resulting mixture was stirred and heated at reflux (130° C.) for 18 hours. The resultant black mixture was cooled to room temperature, about 25° C. throughout, then was treated in a separatory funnel with water and dilute hydrochloric acid. Drying and evaporation to dryness provided 168 grams of crude product as a thick brown oil.

b) Decolorization

The above crude product was then dissolved in 1 liter of heptane and the resultant dark brown solution was stirred at 90° C. with 100 grams of acidic clay (Filtrol F-24, available from Engelhard Industries) and 100 grams of alumina (Grade CG20, available from Alcoa) for 15 minutes. Hot filtration provided a light orange solution. Two subsequent treatments with clay and alumina, followed by evaporation of the filtrate to dryness, provided a thick, light orange oil.

c) Distillation

The above decolorized product was vacuum-distilled at about $1\times10^{-3}$ millibar in a 1 liter capacity Kugelrohr, bulb-to-bulb distillation apparatus (available from Aldrich Chemical Co.). A first fraction collected at a pot temperature of 130° C. over 1½ hours, (49.6 grams of clear liquid) was identified by NMR spectroscopy as excess starting 4-bromo-ortho-xylene along with about 10 percent of the mono-xylyl adduct. The balance of the product distilled at about 150° C. to about 160° C. was a glassy light amber solid.

d) Crystallization and Recrystallization

The above distillate was dissolved in 600 milliliters of boiling ethanol. The solution was cooled to room temperature and the crystallized product was filtered and was washed with 50 milliliters of ethanol followed by 3×100 milliliters portions of methanol. Drying at 50° C. provided the product as light cream-colored crystals (53 grams, 27 percent yield; melting point 62° C.). Recrystallization from 700 milliliters of ethanol, followed by filtration, washing and drying as in the above Example provided 40 grams of purified material suitable for device fabrication.

EXAMPLE II

Synthesis of N,N-Bis(3,4-dimethylphenyl)-4-sec-butylaniline a) Synthesis of Crude Product A 1 liter flask was charged with 4-sec-butylaniline (50 grams, 0.33 mole), 4-iodo-ortho-xylene (163 grams, 0.70 mole), cuprous chloride (1.33 grams, 0.013 mole), 1,10-phenanthrolene (2.42 grams, 0.013 mole) and potassium hydroxide (Technical Flakes, 150 grams, 2.7 mole) and 300 milliliters of toluene. The mixture was stirred and heated at reflux (130° C.) for 27 hours. The resultant black mixture was cooled to room temperature then was treated in a separatory funnel with water and dilute hydrochloric acid as in the above Example. Drying and evaporation to dryness gave the crude product as a thick brown oil.

b) Decolorization

The above crude product was dissolved in 700 milliliters of heptane and the resultant dark brown solution was treated with 50 grams of acidic clay (Filtrol F-24, available from Engelhard Industries) and 25 grams of alumina (Grade CG20, available from Alcoa) for 18 hours at room temperature. Filtration provided a light orange solution, which, upon evaporation to dryness, provided 105 grams of a thick, orange-brown oil.

c) Distillation

The decolorized product was vacuum-distilled at about $1\times10^{-3}$ millibar in a 1 liter capacity Kugelrohr, bulb-to-bulb distillation apparatus (available from Aldrich Chemical Company). A first fraction collected at a pot temperature of 100° C. (12.6 grams of clear liquid) was identified by NMR spectroscopy as excess starting 4-bromo-ortho-xylene. The balance of the product distilled at 130° C. provided 83 grams of a glassy amber solid.

d) Crystallization and Recrystallization

The above distillate of c) was dissolved in 500 milliliters of a boiling 1:1 (volume:volume) mixture of ethanol and hexane. The solution was stored at 0° C. overnight, about 18 hours, and the crystallized product was filtered and washed with 3×50 milliliters of ice-cold hexane. Drying in air at room temperature, about 25° C., provided the product as off-white crystals (57 grams, 48 percent yield; melting point 87° C.). Recrystallization of 53 grams of this product from 900 milliliters of ethanol, followed by filtration, washing and drying provided 42 grams of purified, about 99.8 percent, material (melting point 88° C.), which was used for device fabrication.

EXAMPLES III

Hydroxygalliumphthalocyanine {HOGaPc(V)} Devices

Layered photoconductive imaging members were prepared by the following procedure. A titanized MYLAR® substrate of 75 microns in thickness with a gamma amino propyl triethoxy silane layer, 0.1 micron in thickness, thereover, and E. I. DuPont 49,000 polyester adhesive thereon in a thickness of 0.1 micron was used as the base conductive film. A hydroxygallium phthalocyanine charge generation layer (CGL) was prepared as follows. 0.55 Gram of HOGaPc (V) pigment was mixed with 0.58 gram of poly(styrene-b-4-vinylpyridine) polymer and 20 grams of toluene in a 60 milliliter glass bottle containing 70 grams of approximately 0.8 millimeter diameter glass beads. The bottle was placed in a paint shaker and shaken for 2 hours. The resultant pigment dispersion was coated using a #8 wire rod onto the titanized MYLAR® substrate of 75 microns in thickness, which had a gamma amino propyl triethoxy silane layer, 0.1 micron in thickness, thereover, and E. I. DuPont 49,000 polyester adhesive thereon in a thickness of 0.1 micron film. Thereafter, the photogenerator layer formed was dried in a forced air oven at 100° C. for 10 minutes. Each photogenerator layer was then separately overcoated with a charge transport layer as obtained in the following Examples IIIa, IIIb and IIIc.

COMPARATIVE EXAMPLE IIIa

A transport layer solution was generated by mixing one part of N,N'-diphenyl-N,N'-bis(3-methylphenyl)-1,1-biphenyl-4,4'-diamine (TPD), 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the transport layer was about 20 microns.

EXAMPLE IIIb

The procedure of Example IIIa was repeated using N,N-bis(3,4-dimethylphenyl)-sec-butylaniline (Example II) instead of the TPD. A transport layer solution was generated by mixing one part of N,N-bis(3,4-dimethylphenyl)-sec-butylaniline, 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the transport layer was about 20 microns.

EXAMPLE IIIc

The procedure for Example III was repeated using N,N-bis(3,4-dimethylphenyl)-4-n-butylaniline (Example I) instead of the TPD. A transport layer solution was generated by mixing one part of N,N-bis(3,4-dimethylphenyl)-4-n-butylaniline, 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the transport layer was about 20 microns.

EXAMPLES IV

Dibromoanthanthrone (DBA) Devices

The photogenerator layer was prepared from a pigment dispersion as follows. 0.40 Gram of dibromoanthanthrone pigment was mixed with 0.04 gram of polyvinylbutyral resin and 10.7 grams of methylene chloride in a 30 milliliter glass bottle containing 70 grams of ⅛ inch diameter stainless steel balls. The bottle was placed on a roll mill and milled for 16 hours. The resultant pigment dispersion was coated using a 2 mil blade gap to form the photogenerator layer on an aluminized MYLAR® substrate of 75 microns in thickness, which had a gamma amino propyl triethoxy silane layer, 0.1 micron in thickness, thereover, and E. I. DuPont 49,000 polyester adhesive thereon in a thickness of 0.1 micron. Thereafter, the photogenerator layer formed was dried in a forced air oven at 100° C. for 10 minutes. The photogenerator layer (two devices) was overcoated with the charge transport layer of Examples IVa and IVb resulting in two separate imaging members.

Comparative Example IVa

A transport layer solution was generated by mixing one part of N,N'-diphenyl-N,N'-bis(3-methylphenyl)-1,1-biphenyl-4,4'-diamine (TPD) 1.5 parts polycarbonate resin, and 13.1 parts monochlorobenzene. The solution was coated onto the above photogenerating layer using a film applicator of 10 mil gap. The resulting member was dried at 115° C. in a forced air oven for 60 minutes. The final dried thickness of the transport layer was about 20 microns.

EXAMPLE IVb

The procedure of Example IVa was repeated using N,N-bis(3,4-dimethylphenyl)-sec-butylaniline (Example II) instead of the TPD. A transport layer solution was generated by mixing one part of N,N-bis(3,4-dimethylphenyl)-sec-butylaniline, 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the transport layer was about 20 microns.

EXAMPLE V

Trigonal Selenium (Trig.Se) Devices

A trigonal selenium photogenerator layer was prepared from a pigment dispersion as follows. A dispersion of trigonal selenium and poly(N-vinyl-carbazole) was prepared by ball milling 1.6 grams of trigonal selenium and 1.6 grams of poly(N-vinyl-carbazole) in 14 milliliters each of tetrahydofuran and toluene. Ten grams of the resulting slurry were then diluted with a solution of 0.24 gram of N,N'-diphenyl-N,N'-bis(3-methylphenyl)-1,1-biphenyl-4,4'-diamine (TPD) in 5 milliliters each of tetrahydrofuran and toluene. A 1.5 micron thick photogenerator layer was fabricated by coating the above dispersion onto an aluminized MYLAR® substrate with a Bird film applicator, followed by drying in a forced air oven at 135° C. for 5 minutes. Three of the above photogenerator layers were then separately overcoated with a charge transport layer as described in Examples Va, Vb and Vc, respectively.

Comparative Example Va

A transport layer solution was generated by mixing one part of N,N'-diphenyl-N,N'-bis(3-methylphenyl)-1,1-biphenyl-4,4'-diamine (TPD), 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the transport layer was about 20 microns.

EXAMPLE Vb

The procedure of Example Va was repeated using N,N-bis(3,4-dimethylphenyl)-sec-butylaniline (Example II) instead of the TPD. A transport layer solution was generated by mixing one part of N,N-bis(3,4-dimethylphenyl)-sec-butylaniline N,N-bis(3,4-dimethylphenyl)-sec-butylaniline, 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the transport layer was about 20 microns.

EXAMPLE Vc

The procedure of Example Va was repeated using N,N-bis(3,4-dimethylphenyl)-4-n-butylaniline (Example I) instead of the TPD. A transport layer solution was generated by mixing one part of N,N-bis(3,4-dimethylphenyl)-4-n-butylaniline, 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the hole transport layer was about 20 microns.

EXAMPLE VI

Perylene Dimer Devices

A photogenerator layer was prepared from a pigment dispersion as follows. 0.20 Gram of a chemical mixture of 1,3-bis(n-pentylimidoperyleneimido)propane, Formula 3, $R_1=R_2=$n-pentyl, X=1,3-propylene, 1,3-bis(2-methylbutylimidoperyleneimido)propane, Formula 3, $R_1=R_2=$2-methylbutyl, and 1-(n-pentylimidoperyleneimido)-3-(2-methylbutylimido peryleneimido)propane, Formula 3, $R_1$=n-pentyl, $R_2$=2-methylbutyl and X=1,3-propylene pigments, in a weight ratio, respectively, of about 1:1:2, referred to as perylene dimer pigments, was mixed with 0.05 gram of polyvinylbutyral resin and 3.6 grams of tetrahydrofuran and 3.5 grams toluene in a 30 milliliter glass bottle containing 70 grams of ⅛ inch diameter stainless steel balls. The bottle was placed on a roll mill and milled for 96 hours. The resultant pigment dispersion was coated using a 1.5 mil blade gap to form the photogenerator layer on a titanized MYLAR® substrate of 75 microns in thickness, with a gamma amino propyl triethoxy silane layer, 0.1 micron in thickness, thereover, and E. I. DuPont 49,000 polyester adhesive thereon the adhesive layer in a thickness of 0.1 micron. Thereafter, the photogenerator layer formed was dried in a forced air oven at 100° C. for 10 minutes. The photogenerator layer was coated with the charge transport layer of Example VIa, and in two additional members with the charge transport of VIb and VIc, respectively.

Comparative Example VIa

A transport layer solution was generated by mixing one part of N,N'-diphenyl-N,N'-bis(3-methylphenyl)-1,1-biphenyl-4,4'-diamine (TPD), 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the hole transport layer was about 20 microns.

EXAMPLE VIb

The procedure of Example VIa was repeated using N,N-bis(3,4-dimethylphenyl)-sec-butylaniline (Example II) instead of the TPD. A transport layer solution was generated by mixing one part of N,N-bis(3,4-dimethylphenyl)-sec-butylaniline, 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the hole transport layer was about 20 microns.

EXAMPLE VIc

The procedure of Example VIa was repeated using N,N-bis(3,4-dimethylphenyl)-4-n-butylaniline (Example I) instead of the TPD. A transport layer solution was generated by mixing one part of N,N-bis(3,4-dimethylphenyl)-4-n-butylaniline, 1.5 parts of polycarbonate resin, and 13.1 parts of monochlorobenzene. The solution was coated onto the above photogenerating layer using a film applicator of 10 mil gap. The resulting member was dried at 115° C. in a forced air oven for 60 minutes. The final dried thickness of the hole transport layer was about 20 microns.

The xerographic electrical properties of each imaging member were then determined by electrostatically charging their surface with a corona discharging device until the surface potential, as measured by a capacitively coupled probe attached to an electrometer, attained an initial value $V_o$=800 volts. After resting for 0.5 second in the dark, the charged member reached a surface potential of $V_{ddp}$, dark development potential, and was then exposed to light from a filtered xenon lamp. A reduction in the surface potential to $V_{bg}$, background potential due to photodischarge effect, was observed. The dark decay in volt/second was calculated as $(V_o-V_{ddp})/0.5$. The lower the dark decay value, the superior is the ability of the member to retain its charge prior to exposure by light. Similarly, the lower the $V_{ddp}$, the poorer is the charging behavior of the member. The percent photodischarge was calculated as 100 percent$\times(V_{ddp}-V_{bg})V_{ddp}$. The light energy used to photodischarge the imaging member during the exposure step was measured with a light meter. The photosensitivity of the imaging member can be described in terms of $E_{1/2}$, amount of exposure energy in erg/cm$^2$ required to achieve 50 percent photodischarge from the dark development potential. The higher the photosensitivity, the smaller the $E_{1/2}$ value. High photosensitivity (lower $E_{1/2}$ value), lower dark decay and high charging are desired for the improved performance of xerographic imaging members.

The following Table 1 summarizes the xerographic electrical results obtained for devices generated with the above Examples. The exposed light used was at a wavelength of 400 nanometers.

TABLE 1

Photosensitivities at 400 Nanometers of Photoreceptors Incorporating N,N-bis(3,4-dimethylphenyl)-4-sec-butylaniline and N,N-bis(3,4-dimethylphenyl)-4-n-butylaniline

| Photogenerator | Comparative Example | Example | Dark Decay (V/s) | $E_{1/2}$ (ergs/cm$^2$) | $V_r$ (V) |
|---|---|---|---|---|---|
| HOGaPc (V) | IIIa | | 26 | 7.0 | 14 |
| | | IIIb | 15 | 2.2 | 28 |
| | | IIIc | 17 | 2.3 | 26 |
| DBA | IVa | | 17 | 5.6 | 7 |
| | | IVb | 5 | 4.1 | 22 |
| Trig.Se | Va | | 44 | 4.1 | 10 |
| | | Vb | 42 | 2.3 | 26 |
| | | Vc | 36 | 2.2 | 23 |
| Perylene Dimer | VIa | | 32 | 6.8 | 7 |
| | | VIb | 16 | 5.0 | 23 |
| | | VIc | 14 | 5.4 | 10 |

Examples IIIa, IVa, Va and VIa are Comparative Examples with N,N'-diphenyl-N,N'-bis(3-methylphenyl)-1,1-biphenyl-4,4'-diamine (TPD) in the charge transport layer.

Examples IIIb, IVb, Vb and VIb are based on N,N-bis(3,4-dimethylphenyl)-4-sec-butylaniline in the charge transport layer.

Examples IIIc, Vc and VIc are based on N,N-bis(3,4-dimethylphenyl)-4-n-butylaniline in the charge transport layer.

Improvements in the respective photosensitivities of DBA, HOGaPc (V), trigonal-selenium, and perylene dimer pigment at 400 nanometers exposure were achieved when N,N'-diphenyl-N,N'-bis(3-methylphenyl)-1,1-biphenyl-4,4'-diamine in the CTL was replaced by N,N-bis(3,4-dimethylphenyl)-4-sec-butylaniline or N,N-bis(3,4-dimethylphenyl)-4-n-butylaniline. Photoreceptors incorporating N,N-bis(3,4-dimethylphenyl)-4-sec-butylaniline or N,N-bis(3,4-dimethylphenyl)-4-n-butylaniline in the CTL also resulted in slightly lower dark decay and slightly higher residual voltage compared to photoreceptors incorporating N,N'-diphenyl-N,N'-bis(3-methylphenyl)1,1-biphenyl-4,4'-diamine in the CTL (Charge Transport Layer).

Other embodiments and modifications of the present invention may occur to those skilled in the art subsequent to a review of the information presented herein; these embodiments, modifications, and equivalents thereof, are also included within the scope of the present invention.

What is claimed is:

1. A photoconductive imaging member comprised of a photogenerating layer and a charge transport layer containing a triarylamine of the formula

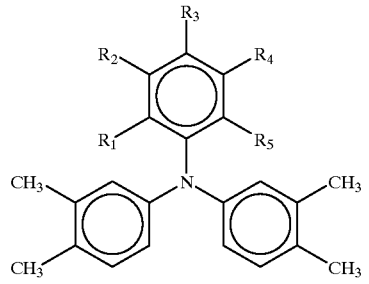

wherein $R_1$, $R_2$, $R_3$, $R_4$, and $R_5$ are each independently alkyl, aryl, hydrogen, or alkoxy.

2. A photoconductive imaging member in accordance with claim 1 wherein each R is alkyl with from 1 to about 25 carbon atoms.

3. A photoconductive imaging member in accordance with claim 1 wherein each R is methyl.

4. A photoconductive imaging member in accordance with claim 1 wherein each R is $CH_2CH_2CH_2CH_3$.

5. A photoconductive imaging member in accordance with claim 1 wherein each R is $CHCH_3CH_2CH_3$.

6. A photoconductive imaging member in accordance with claim 1 wherein each R is $C(CH_3)_3$.

7. A photoconductive imaging member in accordance with claim 1 wherein the triarylamine is N,N-bis(3,4-dimethylphenyl)-4-sec-butylaniline.

8. A photoconductive imaging member in accordance with claim 1 wherein the triarylamine is N,N-bis(3,4-dimethylphenyl)-4-n-butylaniline.

9. A photoconductive imaging member in accordance with claim 1 further containing a supporting substrate.

10. A photoconductive imaging member in accordance with claim 9 wherein there is contained on the substrate an adhesive layer, and wherein the photogenerating layer is situated between said substrate and said transport layer.

11. A photoconductive imaging member in accordance with claim 1 wherein there is further included a supporting substrate in contact with said photogenerating layer, and wherein there is situated on said charge transport layer a polymeric overcoating.

12. A photoconductive imaging member in accordance with claim 1 wherein aryl contains from 6 to about 30 carbon atoms.

13. A photoconductive imaging member in accordance with claim 1 wherein the triarylamine is dispersed in a binder.

14. A photoconductive imaging member in accordance with claim 1 wherein the photogenerating layer is comprised of a metal free phthalocyanine, or wherein the photogenerating layer is comprised of a metal phthalocyanine.

15. A photoconductive imaging member in accordance with claim 1 wherein the photogenerating layer is comprised of a titanium phthalocyanine.

16. A photoconductive imaging member in accordance with claim 1 wherein the photogenerating layer is comprised of a hydroxygallium phthalocyanine.

17. A photoconductive imaging member in accordance with claim 1 wherein the photogenerating layer is comprised of a chlorogallium phthalocyanine.

18. A photoconductive imaging member in accordance with claim 1 wherein the photogenerating layer is comprised of trigonal selenium, chlorogallium phthalocyanine, hydroxygallium phthalocyanine, titanyl phthalocyanines, dibromoanthanthrone, bis(benzimidazo)perylene, N,N'-dipropyl-perylene-3,4,9,10-tetracarboxylic acid diimide, or N,N'-diphenethyl-perylene-3,4,9,10-tetracarboxylic acid diimide.

19. A photoconductive imaging member in accordance with claim 1 further including a supporting substrate of a metal, a conductive polymer, or an insulating polymer, each with a thickness of from about 30 microns to 300 microns optionally overcoated with an electrically conductive layer with an optional thickness of from about 0.01 micron to about 1 micron.

20. A photoconductive imaging member in accordance with claim 1 wherein there is further included an overcoating polymer top layer on said member.

21. A photoconductive imaging member in accordance with claim 1 wherein the photogenerator layer component is dispersed in a resinous binder in an amount of from about 5 percent to about 95 percent by weight.

22. A photoconductive imaging member in accordance with claim 21 wherein the resinous binder is a polyester, a polyvinylcarbazole, a polyvinylbutyral, a polycarbonate, a polyethercarbonate, an aryl amine polymer, a styrene copolymer, or a phenoxy resin.

23. A photoconductive imaging member in accordance with claim 1 wherein the charge transport layer is dispersed in a polymer in an amount of from about 20 to about 60 percent.

24. A photoconductive imaging member in accordance with claim 23 wherein the polymer is a polycarbonate, a polyester, or a vinyl polymer.

25. A photoconductive imaging member in accordance with claim 1 wherein the photogenerating layer is of a thickness of from about 0.2 to about 10 microns, wherein the charge transport layer is of a thickness of from about 10 to about 100 microns, and further including a supporting substrate overcoated with a polymeric adhesive layer of an optional thickness of from about 0.01 to about 1 micron.

26. An imaging method comprising the formation of a latent image on the photoconductive imaging member of claim 1, developing the image with a toner composition comprised of resin and colorant, transferring the image to a substrate, and optionally fixing the image thereto.

27. An imaging member comprised of a photogenerating layer and a charge transport layer containing a component as represented by, or encompassed by the formula

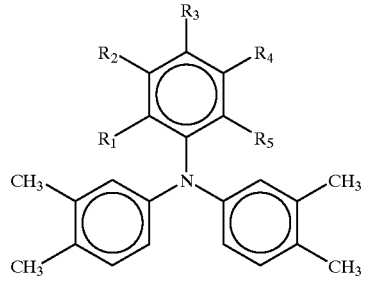

wherein each $R_1$ to $R_5$ is alkyl.

28. An imaging member in accordance with claim 27 wherein alkyl contains from 1 to about 12 carbon atoms.

29. An imaging member in accordance with claim 27 wherein said member includes a supporting substrate, and said photogenerating layer is situated between said substrate and said charge transport, and wherein said charge transport is a hole transport.

30. An imaging member in accordance with claim 27 wherein said component is the triarylamine N,N-bis(3,4-dimethylphenyl)-4-sec-butylaniline, or is N,N-bis(3,4-dimethylphenyl)-4-n-butylaniline.

31. An imaging member comprised of a photogenerating layer and a charge transport layer containing a component of the formula

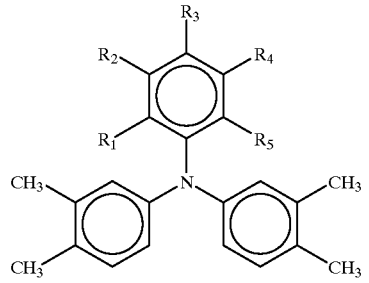

wherein each R, $R_1$ to $R_5$ is aryl.

32. An imaging member in accordance with claim 31 wherein said member includes in sequence a supporting substrate, an adhesive layer, a hole blocking layer, said photogenerating layer and said charge transport layer, and wherein said charge transport is a hole transport.

33. A photoconductive imaging member in accordance with claim 1 wherein a mixture of triphenylamines is selected.

34. A photoconductive imaging member in accordance with claim 1 wherein alkyl is cycloalkyl, and alkoxy contains from about 2 to about 10 carbon atoms.

35. A imaging member in accordance with claim 27 wherein said component is a triphenylamine.

* * * * *